US011390514B1

(12) United States Patent
Piazza et al.

(10) Patent No.: US 11,390,514 B1
(45) Date of Patent: Jul. 19, 2022

(54) LIQUID DISPENSER

(71) Applicant: NIU Enterprises, LLC, Creve Coeur, MO (US)

(72) Inventors: Matthew Charles Piazza, Creve Coeur, MO (US); Tricia Ann Piazza, Creve Coeur, MO (US); Corey Scott Feit, St. Louis, MO (US)

(73) Assignee: NIU Enterprises, LLC, Creve Coeur, MO (US)

( * ) Notice: Subject to any disclaimer, the term of this patent is extended or adjusted under 35 U.S.C. 154(b) by 46 days.

(21) Appl. No.: 16/720,952

(22) Filed: Dec. 19, 2019

Related U.S. Application Data

(60) Provisional application No. 62/782,107, filed on Dec. 19, 2018.

(51) Int. Cl.
*B67D 3/00* (2006.01)

(52) U.S. Cl.
CPC ..... *B67D 3/0051* (2013.01); *B67D 3/009* (2013.01)

(58) Field of Classification Search
CPC .... B65D 47/24; B65D 47/243; B65D 47/245; B65D 47/247; B65D 47/248; B65D 47/32; B67D 3/0032; B67D 3/0035; B67D 3/0051
USPC ..... 220/4.21
See application file for complete search history.

(56) References Cited

U.S. PATENT DOCUMENTS

| | | | | | |
|---|---|---|---|---|---|
| 194,454 | A | * | 8/1877 | Michaels | 220/4.21 |
| 196,605 | A | | 10/1877 | Trepus | |
| 300,867 | A | | 6/1884 | Hauck | |
| 600,901 | A | | 3/1898 | Voelker | |
| 707,193 | A | | 8/1902 | Allison | |
| 1,074,465 | A | | 9/1913 | Rosenauer | |
| 1,403,636 | A | * | 1/1922 | Rhodes | B65D 47/32 222/478 |
| 2,102,520 | A | | 12/1937 | Montmorency | |
| 2,181,612 | A | | 11/1939 | Smith | |
| 2,337,276 | A | * | 12/1943 | Sanchis | B65D 47/248 141/296 |
| 2,338,397 | A | * | 1/1944 | Beasley | B65D 13/04 229/4.5 |
| 2,482,867 | A | * | 9/1949 | Picut | B65D 47/248 222/487 |
| 2,484,391 | A | | 10/1949 | Treiss, Jr. | |
| 2,615,597 | A | | 10/1952 | Tomaske et al. | |
| 3,165,241 | A | | 1/1965 | Curry | |
| 3,782,610 | A | | 1/1974 | Gilbert | |

(Continued)

*Primary Examiner* — Andrew D StClair
(74) *Attorney, Agent, or Firm* — Creativenture Law, LLC; Dennis Jm Donahue, III; Kevin Staed

(57) ABSTRACT

A liquid dispenser has a base with a container section, a top with an elongated neck and a spout, and a push-open valve at the spout's end. An outer section of the valve engages a portion of a receptacle to depress the valve relative to the spout and open the valve and allow fluid to flow from the container through the spout and the valve into the receptacle. The push-open valve is held against the spout with a collar, and a spring biases the valve to its closed position. The top includes an air inlet, and a tube extends from the air inlet to the topside of the base and proximate to a strainer. A bladder can be placed within the interior of the liquid dispenser, and a lid and/or thin-film membrane can seal the base or bladder for storage of mixed drinks or a premix powder or solution.

20 Claims, 6 Drawing Sheets

(56) References Cited

U.S. PATENT DOCUMENTS

| | | | | |
|---|---|---|---|---|
| 4,164,307 | A * | 8/1979 | Imamura | B65D 47/248 222/182 |
| 4,193,698 | A * | 3/1980 | Gartner | B01F 7/0005 206/219 |
| 4,925,055 | A * | 5/1990 | Robbins, III | A61J 1/05 215/12.1 |
| 4,982,881 | A | 1/1991 | Amrein | |
| 5,065,913 | A | 11/1991 | Glasener | |
| 5,079,013 | A | 1/1992 | Belanger | |
| 5,232,110 | A * | 8/1993 | Purnell | B65D 47/06 215/309 |
| 5,518,050 | A * | 5/1996 | Dumas | B65D 25/48 141/351 |
| 6,230,944 | B1 | 5/2001 | Castellano et al. | |
| 6,513,650 | B2 * | 2/2003 | Mollstam | A61J 9/00 206/219 |
| 6,662,493 | B1 | 12/2003 | Bathey | |
| 8,573,425 | B1 * | 11/2013 | Park | B65D 11/04 220/4.05 |
| 8,672,197 | B2 | 3/2014 | Piazza et al. | |
| 2008/0035653 | A1 | 2/2008 | Meli | |

* cited by examiner

LIQUID DISPENSER

CROSS-REFERENCE TO RELATED APPLICATIONS

This application claims priority from U.S. Provisional Patent Application No. 62/782,107 filed on Dec. 19, 2018 which is herein incorporated by reference in its entirety.

STATEMENT REGARDING FEDERALLY SPONSORED RESEARCH

Not Applicable.

APPENDIX

Not Applicable.

BACKGROUND OF THE INVENTION

Field of the Invention

The present invention relates to liquid dispensers, and more particularly to liquid dispensers which have a valve at the end of a container's spout and an outer section of the valve engages a portion of the receptacle to open the valve and allow fluid to flow from the container through the spout and the valve into the receptacle.

Related Art

Liquid dispensers have been used for dispensing fluids into receptacles, such as shot glasses and other drinkware, without unwanted spillage. Shot glasses are typically filled directly from the spout of a bottle or from the spout of a shaker for mixed drinks. To avoid messes and inaccurate pours with the corresponding waste of the drink, bottle stoppers with valves have been developed to dispense the fluids into shot glasses efficiently and accurately without spillage. For example, U.S. Pat. No. 600,901 describes a bottle stopper assembly with a spring-biased tubular stem and valve which allows a person to grasp the bottle and pull back a collar around the tubular stem to open the valve which allows liquid to flow through the stem's center tube. Although the bottle stopper of the '901 Patent could be resized to fit into shakers for mixed drinks, such as U.S. Pat. No. 300,867, the diameter of the spout in a typical shaker container is relatively wide, usually around one-third (⅓) the diameter of the topside opening of the container, because the shaker is designed for pouring the mixed drink out through one side of the spout and a strainer that prevents ice particles from getting into the glass while air is allowed to flow into the container through the other side of the spout and the strainer. By placing the '901 Patent's bottle stopper in the spout, air would be prevented from freely flowing back into the container which would result in a vacuum in the container as the drink is being poured and would result in too slow of a pour. Accordingly, bottle stoppers with valves that push inward to open such as disclosed in the '901 Patent have not been incorporated into the spouts of standard shaker containers. Instead, other types of valves have typically been incorporated into shaker containers.

Some shaker containers have incorporated valves at the bottom of the container which help control the flow of the fluid out of the spout while other shaker containers have incorporated a valve in the cap that must be pulled to open the valve, and some of the shakers vary the size and shape of the spout and sometimes the location of its opening. For example, U.S. Pat. No. 196,605 discloses a shaker with a valve in the bottom of the container which can be depressed to allow air into the container as the drink is being poured from the spout at the opposite end of the shaker and can be released to stop the flow of air and reduce the flow of the drink from the spout. The '605 Patent particularly notes that when the shaker is being shook to mix a drink, the handle should be grasped to ensure that the valve remains closed in its seated position, i.e., pushed against the opening. In another example, U.S. Pat. No. 2,181,612 discloses a shaker with a pump with a spout that extends along the side of the container from an internal aperture at the bottom side of the container to the external aperture toward the top of the container, and the pump has a valve that allows the fluid to flow to the bottom of the container as the pump is pulled upwards into the fluid. U.S. Pat. No. 2,102,520 discloses a long neck and a relatively narrow, elongated pour tube to the spout at the end of the neck, and the spout is again approximately one-third (⅓) the diameter of the topside opening of the container. It will be appreciated that with the long tube, the speed of the fluid flow when pouring the drink is likely going to be less than speed through the shorter spouts in the standard shaped shakers, such as the '867 Patent and the '605 Patent.

Spouts and nozzles with spring-biased flow tubes and valves that open by being pushed inwardly are known to be incorporated into other types of liquid containers that are used to fill tanks and other receptacles, such as fuel containers. For example, U.S. Pat. No. 4,982,881 describes a nozzle assembly that has a spring-biased valve member with a flange, and the assembly has a threaded collar that can screw over a threaded neck of the fuel container. Although a person could push or pull the flange toward the collar to open the valve in a manner similar to the '901 Patent, the '881 Patent explains that the flange can engage with the opening of a tank to push open the valve and allow the fuel to flow from the container through the nozzle's cylindrical tube into the tank. The '881 Patent also describes the optional use of an adapter at the nozzle's discharge outlet for tanks which have an opening that is smaller than the outlet's diameter.

It has also been known to incorporate spring-biased valves into sippy cups and other drinkware containers. For example, U.S. Pat. No. 5,079,013 discloses a valve that is biased closed by a spring. However, in the '013 Patent, the spring biases the body of the spring away from the spout opening to the closed position so that the sucking action overcomes the force of the spring and draws the spring's body toward the spout opening and opens the valve. There is no portion of the valve in the '013 Patent that extends out of the spout because the valve does not open by pressing against the valve. Accordingly, it would change the principle of operation of the '013 Patent and other similar devices to replace the pull-open valve mechanism with a push-open valve mechanism, and if such a replacement were to be done, it would render the new device unworkable for its intended purpose as a sippy cup because the sucking action would not open the valve.

Liquid dispensers in the prior art have also disclosed push-open valves at the end of a flexible, elongated tube. For example, as shown in U.S. Pat. No. 8,672,197, liquid is dispensed through the valve on the end of the tube, and one example of a valve is a push-open valve with a central stem. However, the liquid dispenser disclosed in the '197 Patent either requires a user to use two hands to operate the liquid dispenser, with one hand holding the container and the other hand to operate the valve and dispense the liquid, or for single-handed operation, a stand needs to be used to hold the container. Using two hands to operate the dispenser means that when the user wants to grab something else, they have to drop the tube with the valve, and using a stand limits the user's range of use of the dispenser around the region of the stand.

There remains a need for a liquid dispenser with a push-open valve that can be used with a single hand without the need for a stand. There is also a desire for the dispenser to hold enough liquid to dispense multiple shots before needing to be refilled and to dispense fluid cleanly, without spills, waste, or mess. There is also a desire for efficient flow though the spout and valve, without a vacuum being produced in the container as fluid flows out of the container. Preferably, the push-open valve is operated by contacting an external part of the valve with a portion of the receptacle being filled and pushing the valve against the receptacle.

SUMMARY OF THE INVENTION

A liquid dispenser used to easily fill small containers, i.e. shot glasses, with hot or cold liquids, with precision and speed, without spillage. The liquid dispenser includes a base with a container section, a top with a lower section removably connected to the base an elongated neck and a spout, and a push-open valve at the end of the spout. When the dispenser is turned upside-down, an outer section of the valve engages a portion of a receptacle to depress the valve relative to the spout and open the valve which allows fluid to flow from the container through the spout and the valve into the receptacle. The push-open valve is held against the spout with a collar, and a spring biases the valve to its closed position. The diameter of the top's lower section is approximately equal to the diameter of the base's topside, and the spout's diameter is less than or equal to one-quarter (¼) of the second diameter. The longitudinal length of the top and the valve is greater than the height of the base.

In an aspect of the invention, the top includes an air inlet, and a tube extends from the air inlet to the topside of the base. A strainer can be attached to the top proximate to its lower section and a bottom end of the tube is surrounded by the inner sidewall of a central recess in the strainer.

In another aspect of the invention, the top and bottom can have a quick-connect releasable connection in which a 180° rotation or less of the top and bottom relative to each other change moves the respective parts between locked orientation and an unlocked orientation.

In yet another aspect of the invention, a bladder can be placed within the interior of the liquid dispenser, and a lid and/or thin-film membrane can seal the base or bladder for storage of mixed drinks or a premix powder or solution.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1E is a perspective, cross-sectional view of the liquid dispenser shown in

FIG. 1A.

DETAILED DESCRIPTION OF THE PREFERRED EMBODIMENTS

The following description of the preferred embodiment(s) is merely exemplary in nature and is in no way intended to limit the invention, its application, or uses.

Figures 1A, 2A, 2B:
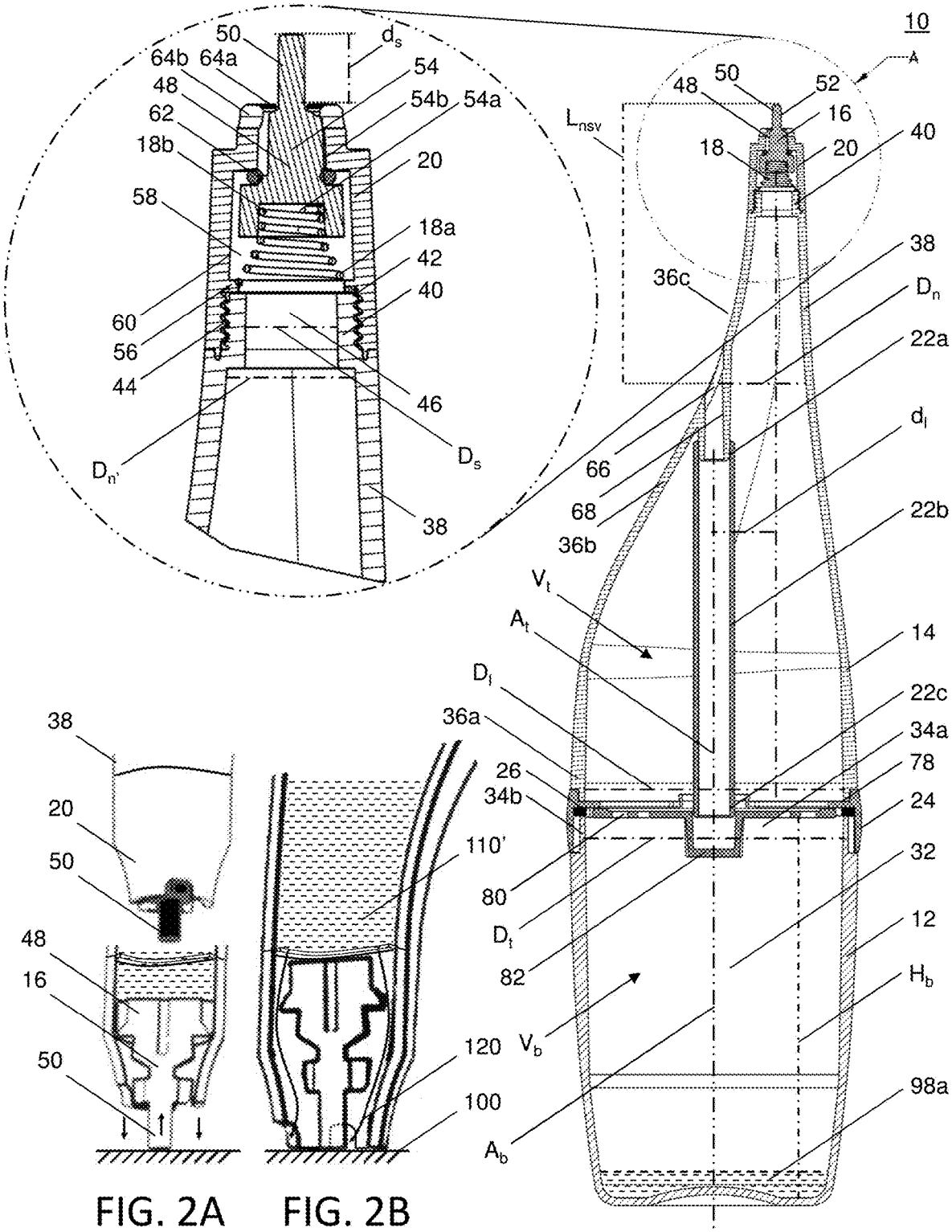
FIG. 1A is a cross-sectional view of a first embodiment of the liquid dispenser and includes a detail view.
FIGS. 2A and 2B are detail views of the valve and tip of the liquid dispenser disengaged from and engaging with the surface of a receptacle.
Figure 1B:
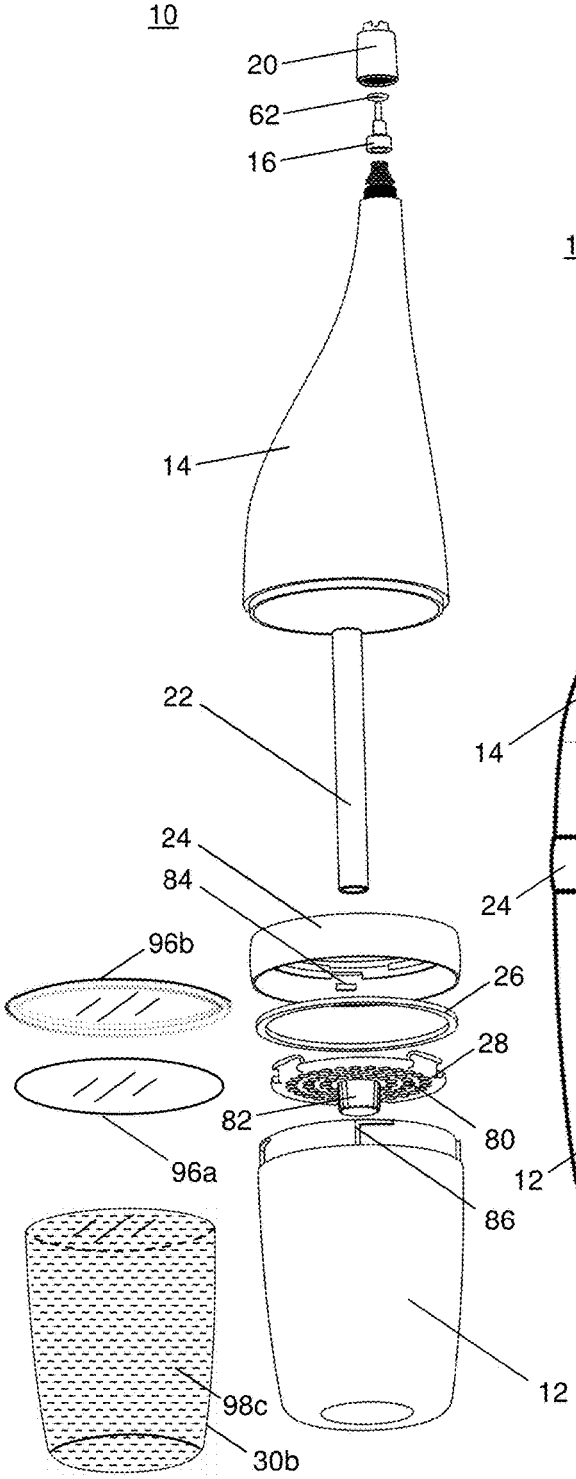
FIG. 1B is an exploded view of the liquid dispenser shown in FIG. 1A.
Figure 1C:
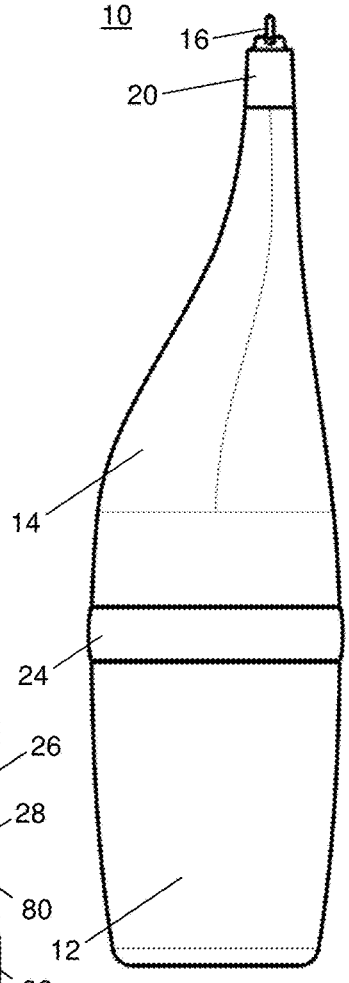
FIG. 1C is a side view of the liquid dispenser shown in FIG. 1A.
Figure 1D:
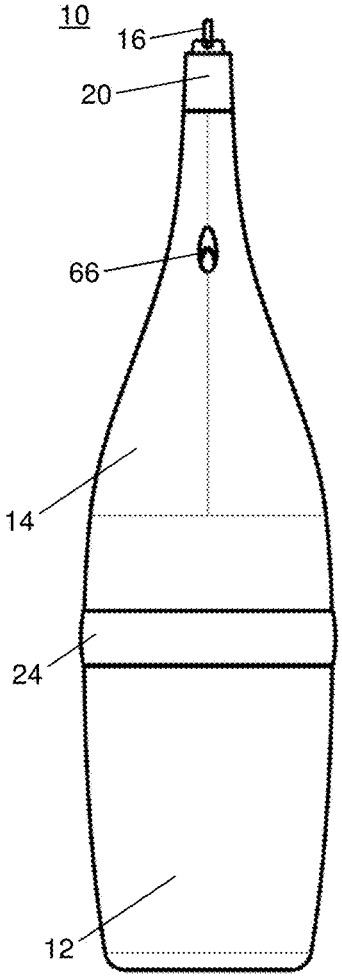
FIG. 1D is a front view of the liquid dispenser shown in FIG. 1A.
Figure 1E:
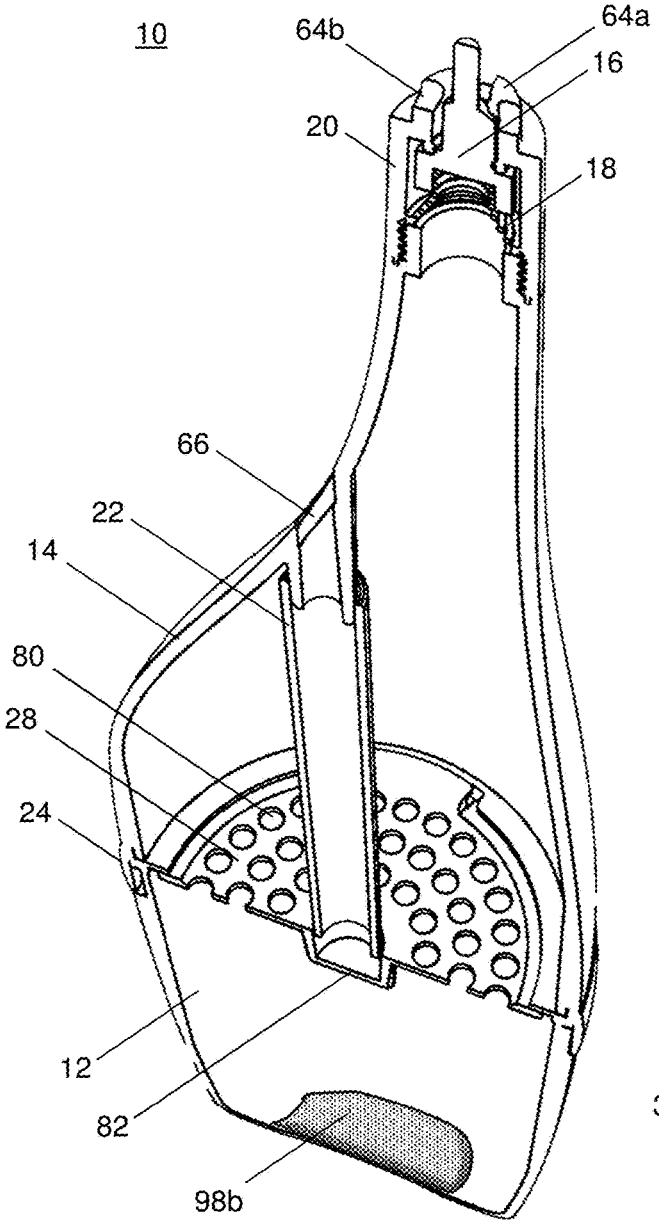
Figure 1F:
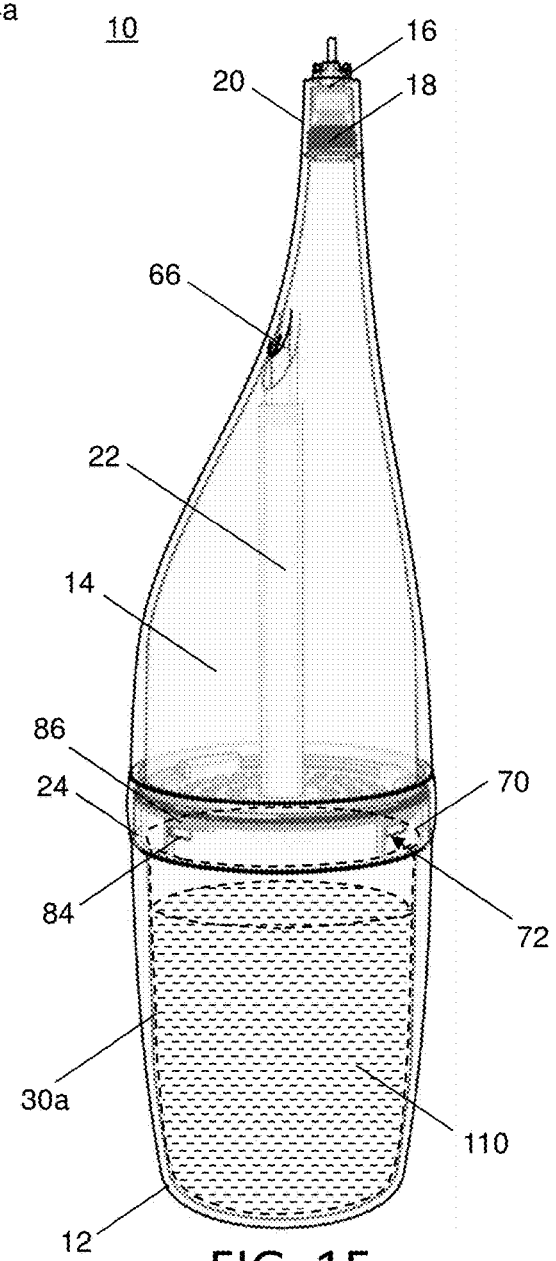
FIG. 1F is a transparent view of the liquid dispenser shown in FIG. 1A.

Generally, as described in detail below and shown in the accompanying drawings, a liquid dispenser 10 has a rigid base 12 connected to a rigid top 14 and a valve 16 connected to a spout 40 of the rigid top. When the dispenser is in its upright orientation and the rigid base is separated from the rigid top, liquid(s) 110 can be poured into the base, and then the top connects to the base to seal the liquid(s) in the dispenser. As particularly shown in FIG. 1A, a spring 18 is preferably held by a collar 20 between the spout and the valve and biases the valve to a closed position. The rigid top has a first arrangement separated from the rigid base as shown in FIG. 1B and a second arrangement connected to the rigid base as shown in FIG. 1F. The collar is attached to the spout and connects the valve to the spout. The valve can be any type of push-open valve in which an outer portion 50 of the valve engages a surface of the receptacle 100, such as when the dispenser is turned upside-down into its inverted orientation as shown in FIG. 2A. As shown in FIG. 2B, when the collar and the spout are moved further toward the receptacle's surface, the outer portion of the valve is pushed back relative to the collar and the spout against the force of the spring, and the inner portion 48 of the valve is unseated, thereby opening the valve and allowing fluid to flow from the container through the spout and the valve into the receptacle. When the spout is moved back away from the receptacle, the spring biases the valve back to its closed position so no fluid can exit the dispenser even when the dispenser is upside-down.

According to each one of the embodiments of the invention, the rigid base 12 has a container section 32 with an open end 34*a* at its topside 34*b*. The rigid base has a central longitudinal axis ($A_b$), a height ($H_b$), and an internal volume ($V_b$), and the topside of the container section has a topside diameter ($D_t$) of its circular cross-section 70. The rigid top 14 has a lower section 36*a*, a tapered section 36*b*, and an upper section 36*c*. The lower section of the rigid top connects to the topside of the container section 32. The lower section of the rigid top also has a circular cross-section with a diameter ($D_t$) that is approximately equal to the topside diameter ($D_l \approx D_t$), and the spout has a diameter ($D_s$) that is less than or equal to one-quarter (¼) of the lower section's diameter ($D_s \leq ¼ * D_l$) and is preferably less than one-fifth (⅕) of the lower section's diameter ($D_s < ⅕ * D_l$). The height of the rigid base is preferably greater than the diameter of the topside of the container section ($H_b > D_t$). The upper section of the rigid top has an elongated neck 38 that extends to the spout 40. The elongated neck and the spout are offset a lateral distance ($d_l$) from the central longitudinal axis, and the neck's diameter ($D_n$) is less than or equal to one-third (⅓) of the lower section's diameter ($D_n \leq ⅓ * D_l$), and the spout's diameter is less than the narrowest portion of the neck's diameter ($D_s < D_n$)

The valve 16 can preferably be removed from the neck and the spout by the releasable connection between the collar 20 and the spout 40 which would allow pouring out of the spout without any valve mechanism or for ease of cleaning the valve, spout, and collar between uses of the dispenser. A threaded engagement is preferably used for releasable connection between the collar and the spout. The spout has an external thread 42 and the collar has an internal thread 44 that mates with and screws onto the spout's external thread. The collar also has a central aperture 46, and the valve's outer portion 50 extends through the central aperture while the spring 18 is situated between the valve's inner portion 48 and the spout.

Figure 3A:
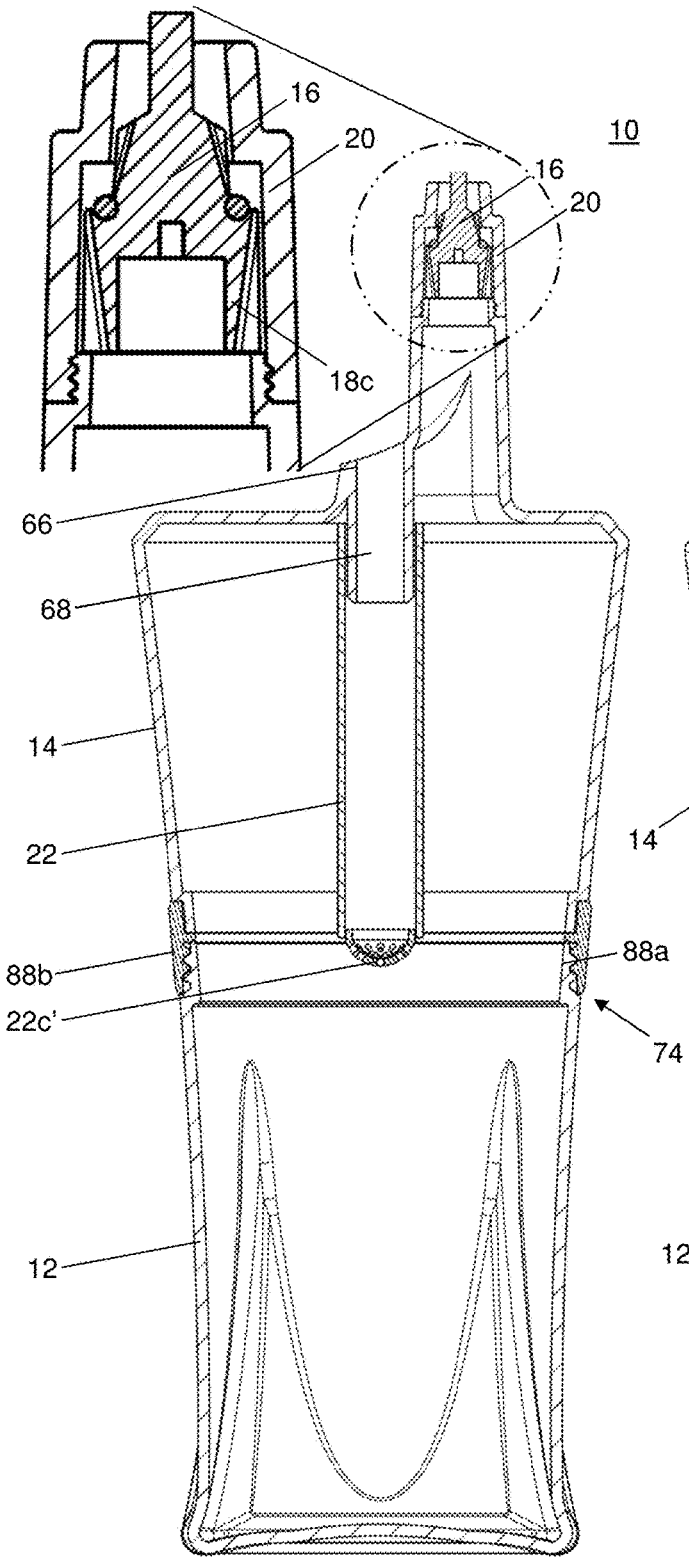
FIG. 3A is a cross-sectional view of a second embodiment of the liquid dispenser and includes a detail view.

As shown in the drawings, the preferred push-open valve mechanism is a spring-biased stem-valve, and the valve may be a stem-valve without any spring or may be a spring-biased tube-valve. For the preferred valve 16 shown in FIG. 1B, the valve's outer portion has a central stem 52, and the valve's inner portion has a valve body 54*a* with a center bore 54*b* and a peripheral surface 54*c*. The collar includes an interior flange 56, a central space 58, and an internal sidewall 60 between the internal threads and the central aperture, and the spring is preferably a spiral compression spring with a wide end 18*a* that engages the interior flange and a narrow end 18*b* that engages with and is seated within the center bore in the valve body. The wide end of the spring may engage with the top of the spout rather than the interior flange. The central stem protrudes a distance ($d_s$) from the central aperture, and the spring pushes the valve body toward the central aperture when the valve is in the closed position as shown in FIG. 1A. The stem is pushed the distance toward the central aperture, and the valve body is moved away from the central aperture toward the spout when the valve is in the open position as shown in FIG. 2B. As shown in FIG. 3A, the base of the valve body may alternatively be formed with tapered flaps 18*c* that can function as a spring. It will also be appreciated that no spring may be necessary for the push-open valve because when the dispenser is inverted, gravity will cause the valve to close because the weight of the valve and the pressure of the fluid forces the valve into the closed position as shown in the cross-sectional view of FIG. 2A; however, it is likely that some liquid could leak from the interior space of the collar and the spout as the valve is closing so the spring is preferable to bias the valve in the closed position even when the dispenser is in its upright orientation.

The peripheral surface of the valve body could seal directly against the collar's internal sidewall as shown by the closed position of the valve in FIG. 2A. However, as shown in FIG. 1A, preferably an O-ring 62 produces the seal between the valve body and the collar's internal sidewall. In particular, the O-ring is secured around the peripheral surface of the valve body and engages with a circumferential ledge in the internal sidewall around the central aperture. Accordingly, the O-ring is seated against the internal sidewall of the collar when the valve is in the closed position, and the O-ring is unseated from the internal sidewall when the valve is in the open position. The circumferential ledge within the central space of the collar is preferably formed by a tip 64*a* of the collar which has notched standoffs 64*b* around the central aperture which provide flow paths 120 for the fluid through the spout and valve and out of the tip into the receptacle 100 as it pushes against and depresses the valve's outer portion.

As explained in the background section above, traditional containers typically have a relatively wide spout as compared to the container base and do not have a valve in the spout so air can enter into the container as the fluid is poured through the spout. However, when there is a valve in fluid communication with the spout as in the present invention, it is more difficult for air to enter the container through the valve and spout as the liquid is being poured out which can create a vacuum in the container and prevent fluid from flowing out of the spout and the open valve, especially if the container section is full of liquid. An air inlet 66 is preferably be incorporated into the dispenser apart from the spout to allow air into the container as the fluid flows out.

Figure 3B:
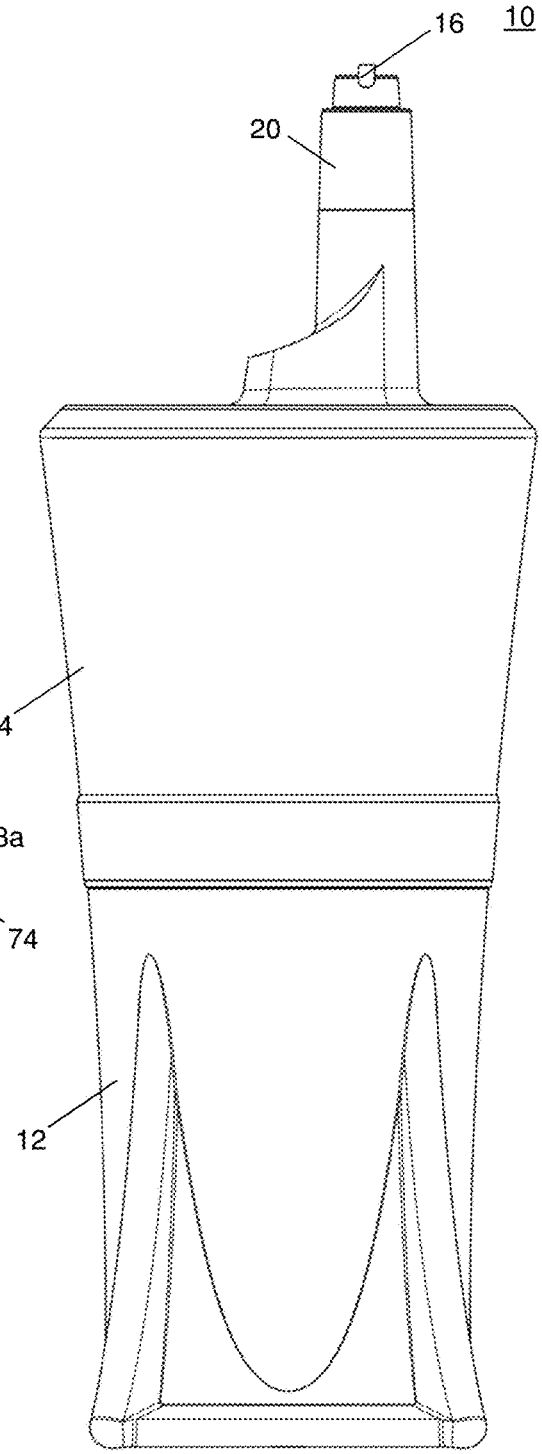
FIG. 3B is a side view of the liquid dispenser shown in FIG. 3A.

In the embodiments shown in FIGS. 1 and 3, a peripheral wall 68 surrounds the internal side of the air inlet 66 and extends into the interior space of the rigid top. The air inlet and peripheral wall are preferably formed in the tapered section of the rigid top so that if a small amount of fluid leaks from the air inlet when the dispenser is upside-down in its inverted orientation, the fluid will be directed to the tip at the end of the spout and help prevent a spill outside the receptacle. A tube 22 preferably connects to the peripheral wall at its top end 22*a*, and the tube's center section 22*b* extends toward the container section to the tube's bottom end 22*c* proximate to the open end of the topside of the container section. Preferably, the tube's bottom end extends to the plane of the opening in the topside, and as discussed below, the tube may extend below the opening plane. The tube has a central axis ($A_t$) that is aligned with the central longitudinal axis ($A_b$) of the rigid base ($A_t | A_b$).

The tube functions with the air inlet as a type of a valve that allows air into the container section of the dispenser when the dispenser is in its inverted orientation and allows the free flow of ambient air outside the dispenser and the air in the rigid top when the dispenser is in its upright orientation. It will be appreciated that the air inlet could incorporate other types of valves, and the air inlet could be formed in different locations of the liquid dispenser. For example, the air inlet could incorporate a valve assembly similar to the air inlet valve described in the U.S. Pat. No. 5,079,013 which is incorporated by reference herein. As in the '013 Patent, the air inlet valve could be located at the bottom of the dispenser in the container section or at the top of the dispenser in the rigid top. It will also be appreciated that an air inlet valve could be located at the bottom of the tube which may extend all the way to the bottom of the dispenser. These types of air inlet valves which have a spring operate when the force of the spring is overcome by an air pressure differential between the ambient air and a lower pressure within the dispenser as fluid exits the dispenser (even if it is a flap valve, the spring force is inherent to the flap structure). Therefore, the inclusion of such pressure activated valves has been found to slow the flow of the fluid from the dispenser, and the tube is preferred to provide a quick and smooth continuous flow through the spout and valve out of the tip.

The dispenser can be filled with cold liquids, ambient temperature liquids, or hot liquids. When the container section of the dispenser is filled with a hot liquid, the liquid heats up the air in the dispenser which increases the pressure of the air in the dispenser. When the tube is used with the air inlet, the free flow of air between the ambient conditions external to the dispenser and the air within the dispenser prevents any buildup of pressure within the dispenser. However, if an air inlet valve is used instead of the tube, a pressure-relief valve would preferably be incorporated into the top section of the dispenser to relieve the pressure buildup from hot liquids to the air within the dispenser.

Figure 4A:
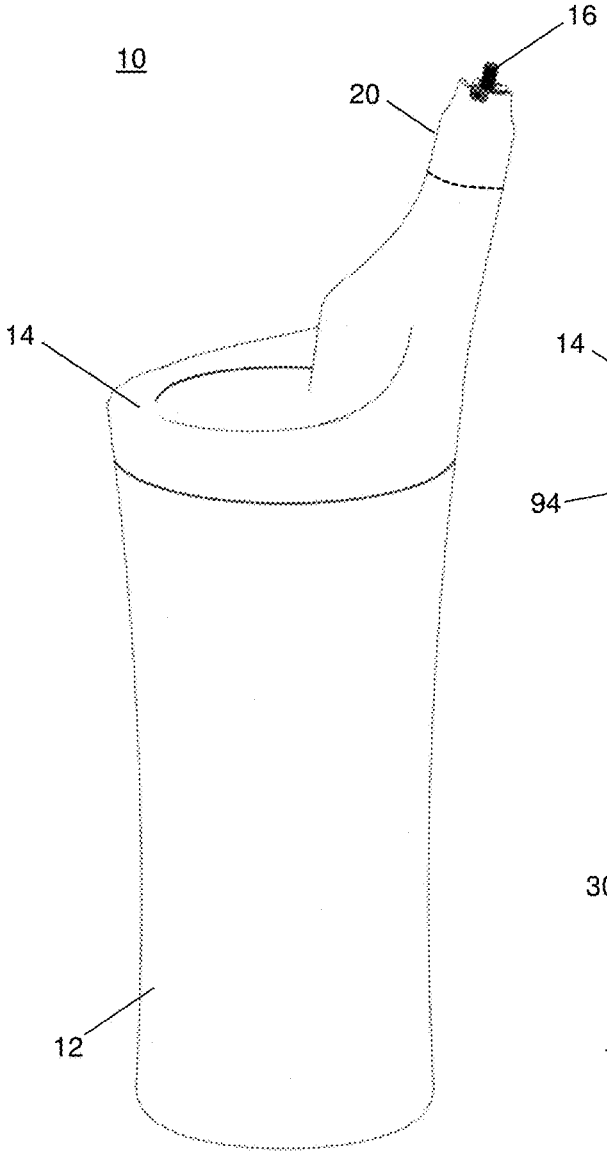
FIG. 4A is a perspective view of a third embodiment of the liquid dispenser.

In all of the embodiments, the combined length ($L_{nsv}$) of the elongated neck, the spout, and the outer portion of the valve is greater than one-half (½) of the topside's diameter ($L_{nsv}>½*D_t$) and is preferably greater than two-thirds (⅔) of the topside's diameter ($L_{nsv}>⅔*D_t$). The length ($L_{vv}$) of the narrowest part of the rigid top, measured from the vent in the tapered section to the outer portion of the valve, is preferably equal to or greater than the topside's diameter ($L_{vv}\geq D_t$). In the embodiments shown in FIGS. 1 and 3, the longitudinal length ($L_t$) of the rigid top from the lower section to the outer portion of the valve is greater than the rigid base height ($L_t>H_b$). The larger size of the rigid top relative to the rigid base preferably results in the combined internal volume ($V_t$) of the rigid top and the valve from the spout to the bottom of the tube being greater than or approximately equal to the internal volume of the rigid base ($V_t\geq V_b$). The relatively large volume in the rigid top in these embodiments is different from traditional shaker containers and other fluid dispensers which tend to maximize the a much larger volume of the container section in the base of the dispenser and as compared to the volume in the top section ($V_b>>V_t$) which may only be a cap with a nozzle or other type of elongated neck extending to a spout, such as the top section of the embodiment shown in FIG. 4. The increased volume in the embodiments of FIGS. 1 and 3 could be empty space that only contains air when the liquid dispenser is in its upright orientation or may contain ice or natural or artificial flavor enhancers.

Figure 4B:
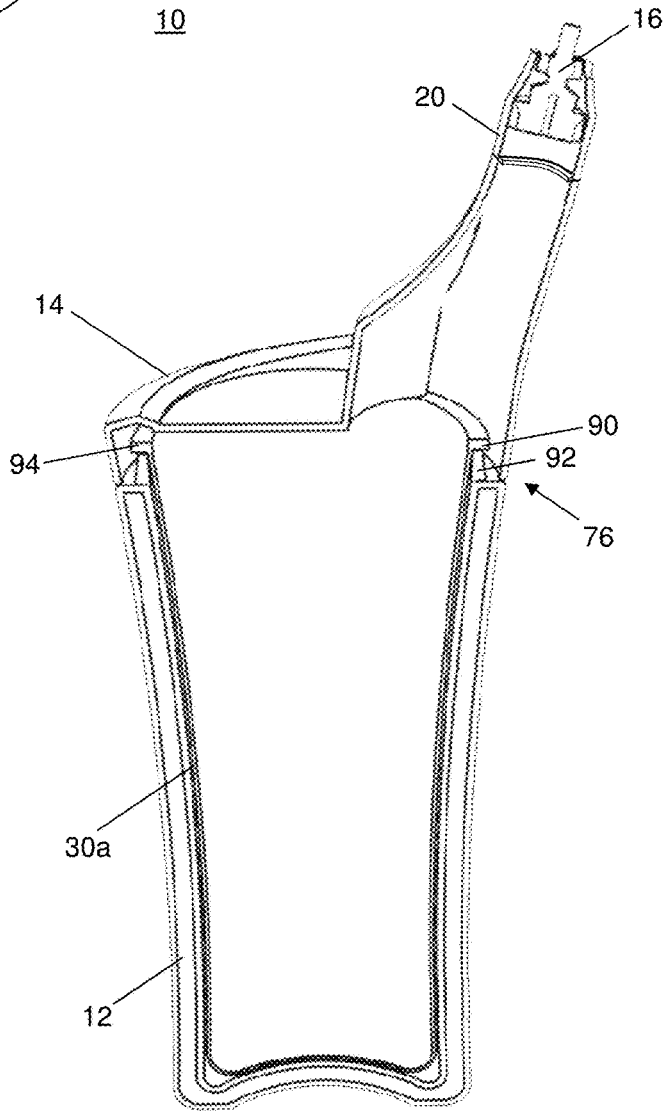
FIGS. 4B and 4C respectively are a cross-sectional view and an exploded view of the liquid dispenser shown in FIG. 4A.

The rigid top can be connected to the rigid base by any known releasable fastening mechanism or other mechanisms developed in the future. As explained in detail below, the releasable fastening mechanism in the embodiment shown in FIGS. 1A-1F has quick-connect features that allow a 180° rotation or less between the rigid top and the rigid base to move the respective parts relative to each other between a locked orientation and an unlocked orientation. Preferably, the locked orientation and the unlocked orientation are achieved with a quick-connect bayonet mount 72 hat only requires rotating the rigid top and the rigid base relative to each other by a quarter-turn or less (i.e., ≤90°). As shown in FIG. 3A, the releasable fastening mechanism can be a threaded connection 74 between threads in the rigid top and threads in the topside of the rigid base. As shown in FIG. 4B, the releasable fastening mechanism can be a snap-fit connection 76 between a circumferential lip and groove in the rigid top and a circumferential lip and groove with a complementary mating shape around the circumference of the rigid top.

As shown in FIG. 1B, the liquid dispenser can also include a mounting ring 24, a gasket 26, and a strainer 28 between the topside of the container section and the lower section of the rigid top. The mounting ring is preferably attached to the rigid top through an overmolding process or may be integrally formed as a part of the lower section depending on the material used for the rigid top. The mounting ring preferably has an internal flange 78, and the gasket is sandwiched between the internal flange and the topside of the container section. As discussed above with regard to the locking and unlocking of the rigid top and the rigid base, the mounting ring moves with the rigid top between the locked orientation and the unlocked orientation. The strainer is secured to the mounting ring between the lower section of the rigid top and the topside of the container section. The strainer has apertures 80 throughout its surface and a center recess 82 without apertures. The tube's bottom end 22*c* extends into the upper part of the center recess, and there is a space between the tube's outer circumference at the bottom end and the center recess' the inner sidewall. The center recess acts as a splashguard so that as the container is turned upside-down, the center recess covers the tube's open bottom end and directs the fluid moving from the container section toward the neck and spout around the bottom end of the tube to ensure that fluid does not leak out from the venting hole. The strainer is preferably fastened to the ring through a releasable connection so that ice can be placed in the top part of the dispenser and the strainer holds the ice out of the liquid in the container section, preventing dilution of the liquid. Then, when the dispenser is turned upside-down to fill a shot glass with the mixed drink, a bolus 110' of the liquid is chilled as it passes through the ice without much dilution. As shown in FIG. 3A, the tube's bottom end may include a cover with one or more apertures 22*c*' that serve as a splashguard, and the splashguard may be integrally formed with the tube or attached to the tube's bottom end.

Figure 4C:
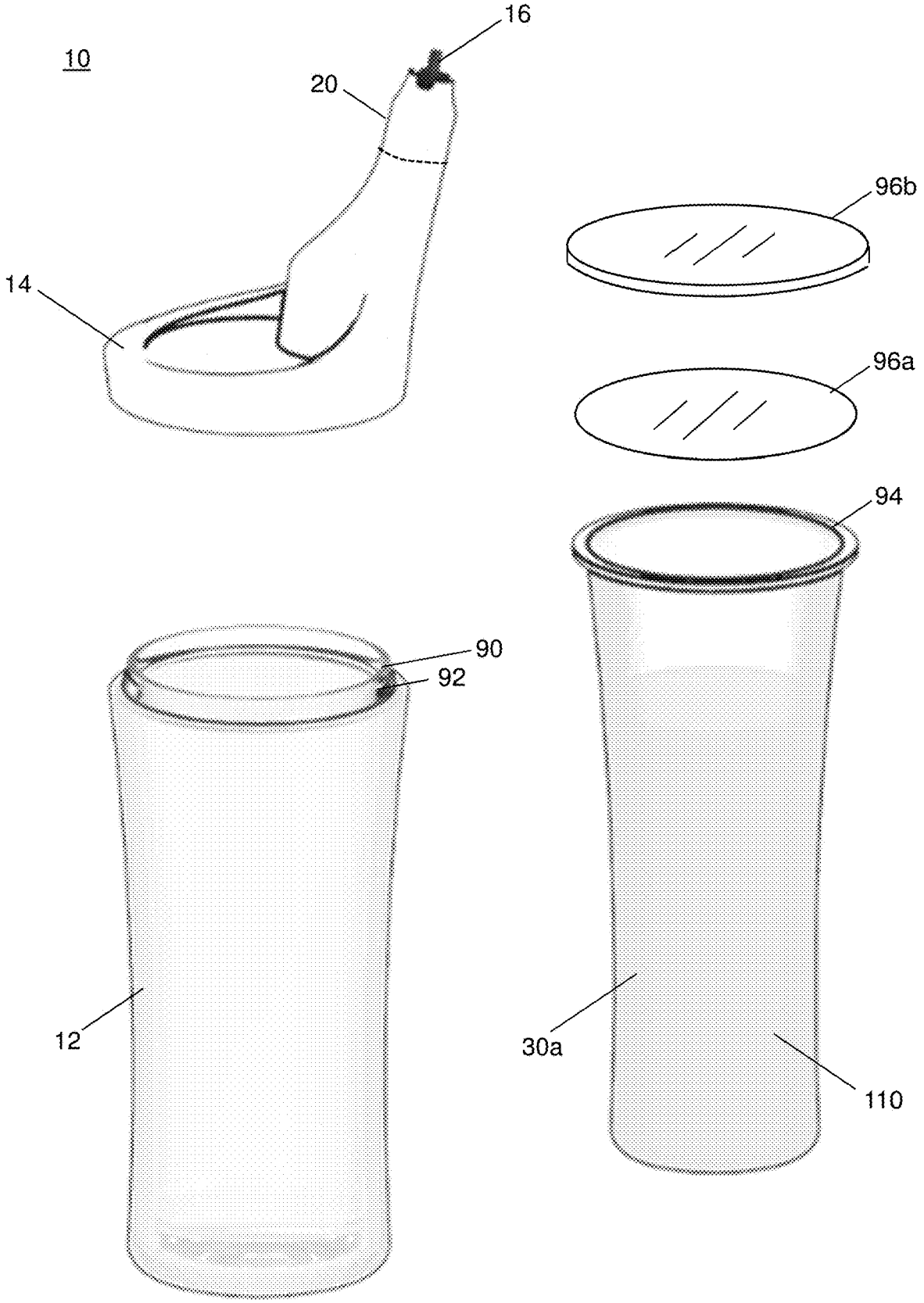

Returning to the optional releasable fastening mechanisms between the topside of the rigid base's container section and the rigid top, either directly with the lower section or through the mounting ring, the fastening mechanism shown in FIGS. 1B and 1F is a type of bayonet mount 72 with tabs 84 extending from the mounting ring and elongated ridges 86 extending from the topside of the container section. The ridges preferably have a vertical segment and a horizontal segment; the horizontal segment hooks over the tabs, and the vertical segment acts as a stop to the rotation between the rigid top and the rigid bottom. It will be appreciated that the tabs could extend from the topside of the container section while the ridges extend from the mounting ring or directly from the lower section of the rigid top. Additionally, as with other bayonet mounts, the ridges could actually be a recessed groove or even a slot. As shown in FIG. 3A, the threaded connection 74 has mating threads on the topside as well as on the mounting ring or the lower section which results in a threaded topside 88*a* for the container section and a threaded screw-on 88*b* for the rigid top. As shown in FIGS. 4B and 4C, the snap-fit connection 76 has a lip 90 projecting radially outward from a recessed groove 92 around a circumference of the topside which engages and fits with a complementary mating shape around the circumference of the rigid top. Since the embodiment shown in FIGS. 4B and 4C preferably includes a bladder 30, the snap-fit connection would also accommodate a flange 94 around the top of the bladder. The releasable fastening mechanism could alternatively be a friction-fit connection (or interference-fit) as is found in existing shaker containers, such as U.S. Pat. No. 300,867 which is incorporated by reference herein.

According to the various designs of the liquid dispenser according to the present invention, the rigid base, an open bladder 30*a* or a sealed bladder 30*b* can be situated within the container section of the rigid base. Preferably, the flange in the top of the open bladder is secured between the topside of the container section and the lower section of the rigid top. It will also be appreciated that with any one of the embodiments shown in the drawings, the rigid base may have a thin-film membrane 96*a* and/or a removable lid 96*b* that is attached to the topside of the container section and covers the open end in a sealed configuration. The thin film membrane and/or the removable lid is detached from the topside of the container section in an unsealed configuration. In the sealed configuration, the container section may contain a premix solution 98*a*, a premix powder 98*b*, or a premixed beverage 98*c*. When a bladder is used with the liquid dispenser, the sealed bladder could also contain the premix solution 98*a*, the premix powder 98*b*, or the premixed beverage 98*c*.

The bladder and/or the sealed container section can be a consumable item that contains the premixed beverage or may be a reusable part of the liquid dispenser. For example, as a reusable part of the liquid dispenser, the container sections of multiple rigid bases could be prefilled with a drink mixture, lids then cover the drink mixture, and the sealed container sections are refrigerated until they are needed. To use the prefilled rigid bases, the lid is simply removed from each one of the sealed container sections, and the unsealed container sections are connected to the rigid top as described above. It will be appreciated that the sealed bladder can be formed generally in the shape of the interior space of the rigid base, i.e, a form-fit bladder, and can have a thin-film membrane that seals the top. Alternatively, the sealed bladder may be formed as a pouch from plies of a flexible material that may be heat-welded together. The bladder may be large enough to fit the interior space of both the rigid top as well as the rigid base in which case the large bladder's volume ($Vl_b$) would almost equal to the volume of both to top and the base ($V_{lb} \approx V_b + V_t$). The large bladder would likely connect to the spout and could extend through the spout and have a flexible flange that is secured between the collar and the spout (not shown). The tube described above would not be used with the large bladder.

Various modifications can be made to the features of the invention as described above and as shown in the drawings without departing from the scope of the present invention. For example, as indicated above, the rigid base and rigid top preferably have a diameter that allows for a user to grasp around the container, but the container may have a larger diameter depending on the particular use. A larger container may have a handle connected to the rigid top and/or the rigid base. Additionally, it will be appreciated that alternative valves can be used with the liquid dispenser of the present invention. In addition to the stem-valve shown particularly shown in the drawings and described above, other valves may be used, such as various types of spring-biased tube-valves.

An example of a spring-biased tube valve is the stopper assembly that is described in the U.S. Pat. No. 600,901. The stopper assembly be incorporated into the dispenser of the present invention as a spring-biased tub valve and is hereby incorporated by reference herein as such. The shape of the tubular stem's tip would preferably be modified according to aspects of the invention described above. In particular, the valve opening in the '901 Patent would preferably be modified to include slots, standoffs, or holes in the stem that would allow fluid to freely flow out of the stem when the valve is opened by pressing the tip of the stem flush against the bottom surface of the receptacle. As evident from the '901 Patent, the length of the tube extending out from the collar (or stopper) can have a length that is greater than the collar.

As with the '901 Patent, the nozzle assembly disclosed in U.S. Pat. No. 4,982,881 could also be used with the container of the present invention and is also hereby incorporated by reference herein. As described in the '881 Patent, the spring-biased tube-valve can have a flange that engages with the top rim of the receptacle which pushes the valve open and allows the fluid to flow from the container through the nozzle's cylindrical tube into the tank. Similar to the '881 Patent, adapters may optionally be used at the nozzle's discharge outlet for drinkware which have an opening that is smaller than the outlet's diameter. Generally, for each one of the push-open type of valves used for the liquid dispenser of the present invention, the inner portion of the valve is adjacent to the spout and the outer portion of the valve extends away from the spout. The outer portion of the valve moves toward the spout in an open position of the valve, and the outer portion of the valve moves away from the spout in a closed position of the valve.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although a shot glass is the preferred receptacle for use with the liquid dispenser of the present invention, it will be appreciated that other types of drinkware and other receptacles can be used with the liquid dispenser. Additionally, as evident from the description of the present invention, including the references incorporated by reference, the length of the valve stem, the valve tube, and the valve flange or any valve flange inserts at the end of the spout can be varied depending on the drinkware being used with the liquid dispenser. Similarly, the outer diameter of the valve flange and valve flange inserts can be varied depending on the drinkware. Thus, the breadth and scope of the present invention should not be limited by any of the above-described exemplary embodiments, but should be defined only in accordance with the following claims appended hereto and their equivalents.

What is claimed is:

1. A liquid dispenser, comprising:

a rigid base comprising a container section and an open end at a topside of the container section, wherein the topside has a first diameter;

a rigid top comprising a lower section and an upper section, wherein the upper section further comprises an elongated neck extending to a spout, wherein the lower section has a second diameter approximately equal to the first diameter of the topside, wherein the spout has a third diameter less than or equal to one-quarter the second diameter, and wherein the rigid top has a first arrangement separated from the rigid base and a second arrangement connected to the rigid base;

a valve connected to the spout, wherein the valve is further comprised of an inner portion adjacent to the spout and an outer portion extending away from the spout, wherein the outer portion of the valve moves toward the spout in an open position of the valve, wherein the outer portion of the valve moves away from the spout in a closed position of the valve, wherein the outer portion of the valve is further comprised of a central stem, and wherein the inner portion of the valve is further comprised of a valve body with a center bore and a peripheral surface;

a spring operatively engaging the valve and the spout, wherein the spring biases the valve to the closed position; and a collar, wherein the spout is further comprised of an external thread, wherein the collar is further comprised of an internal thread and a central aperture, wherein the internal thread of the collar screws onto the external thread of the spout, wherein the outer portion of the valve extends through the central aperture in the collar, and wherein the spring is situated between the inner portion of the valve and the spout, wherein the collar is further comprised of an interior flange, a central space, and an internal sidewall between the internal threads and the central aperture, wherein one end of the spring engages the interior flange in the collar and another end of the spring engages with the center bore of the valve body, wherein the central stem protrudes a distance from the central aperture and the spring pushes the valve body toward the central aperture when the calve is in the closed position, and wherein the stem is pushed the distance toward the central aperture and the valve body is moved away from the central aperture of the collar toward the spout when the valve is in the open position.

2. The liquid dispenser of claim 1, further comprising an O-ring secured around the peripheral surface of the valve body within the central space of the collar, wherein the O-ring is seated against the internal sidewall of the collar when the valve is in the closed position, wherein the O-ring is unseated from the internal sidewall when the valve is in the open position, and wherein the collar further comprises a tip with a plurality of notched standoffs around the central stem.

3. The liquid dispenser of claim 1, further comprising a tube, wherein the tube is comprised of a top end, a bottom end, and a center section between the top end and the bottom end, wherein the top section is further comprised of an air inlet spaced from the spout, and wherein the top end of the tube connects to the air inlet.

4. The liquid dispenser of claim 3, wherein the rigid top further comprises a tapered section between the lower section and the elongated neck in the upper section, wherein the rigid base has a central longitudinal axis, and wherein the elongated neck and the spout are offset a lateral distance from the central longitudinal axis, wherein the tapered section of the rigid top is further comprised of the air inlet and a peripheral wall around the air inlet extending internally within the rigid top, wherein the top end of the tube connects to the peripheral wall, wherein the center section of the tube extends toward the container section, wherein the tube has a central axis aligned with the central longitudinal axis of the rigid base, and wherein the bottom end of the tube is located proximate to the open end of the topside of the container section.

5. The liquid dispenser of claim 4, further comprising a mounting ring, a gasket, and a strainer, wherein the topside of the container section has a circular cross-section, wherein the mounting ring connects the lower section of the rigid top to the topside of the container section and is comprised of an internal flange, wherein the mounting ring moves between a locked orientation and an unlocked orientation relative to the lower section and the topside with less than a 180° rotation between the rigid top and the rigid base, wherein the strainer is secured to the mounting ring between the lower section of the rigid top and the topside of the container section, wherein the strainer is comprised of a plurality of apertures and a center recess, wherein the bottom end of the tube extends to the center recess, and wherein the gasket is sandwiched between the internal flange of the mounting ring and the topside of the container section.

6. The liquid dispenser of claim 4, wherein the spout has a third diameter less than or equal to one-fifth the second diameter, wherein the elongated neck has a fourth diameter less than or equal to one-third the second diameter, wherein a combined length of the elongated neck, the spout, and the outer portion of the valve is greater than one-half the first diameter, and wherein an internal volume of the rigid base is less than a combined internal volume of the rigid top and the valve from the spout to the bottom of the tube.

7. The liquid dispenser of claim 1, wherein the rigid base has a height greater than the first diameter of the topside of the container section, and wherein a longitudinal length from the lower section of the rigid top to the outer portion of the valve is greater than the rigid base height.

8. The liquid dispenser of claim 1, wherein the rigid base further comprises at least one of a thin-film membrane and a removable lid, wherein the thin-film membrane or the removable lid is attached to the topside of the container section and covers the open end in a sealed configuration, and wherein the thin film membrane or the removable lid is detached from the topside of the container section in an unsealed configuration.

9. The liquid dispenser of claim 8, wherein the container section further comprises at least one of a premix solution, a premix powder, and a premixed beverage in the sealed configuration, and wherein the valve is at least one of a stem-valve and a tube-valve.

10. The liquid dispenser of claim 1, further comprising at least one of an open bladder and a sealed bladder situated within the container section of the rigid base, wherein a top of the open bladder is secured between the topside of the container section and the lower section of the rigid top.

11. A liquid dispenser, comprising:

a rigid base comprising a container section and an open end at a topside of the container section;

a rigid top comprising a lower section and an upper section, wherein the upper section further comprises an elongated neck extending to a spout, wherein the upper section comprises an air inlet spaced distance from the spout, wherein the rigid top has a first arrangement separated from the rigid base and a second arrangement connected to the rigid base, and wherein the rigid top is further comprised of a peripheral wall around the air inlet extending internally within the rigid top;

a tube comprised of a top end, a bottom end, and a center section between the top end and the bottom end, wherein the top end of the tube connects to the peripheral wall around the air inlet, wherein the center section of the tube extends toward the container section, and wherein the bottom end of the tube is located proximate to the open end of the topside of the container section; and a valve connected to the spout, wherein the valve moves relative to the spout between a closed position and an open position, and wherein a longitudinal length of the rigid top and the valve is greater than the height of the rigid base.

12. The liquid dispenser of claim 11, wherein the topside has a circular cross-section and a first diameter, and wherein the rigid base has a height greater than the first diameter, wherein the lower section has a second diameter approximately equal to the first diameter of the topside, wherein the spout has a third diameter less than or equal to one-quarter the second diameter.

13. The liquid dispenser of claim 11, wherein the valve is further comprised of an inner portion adjacent to the spout and an outer portion extending away from the spout, wherein the outer portion of the valve moves toward the spout in an open position of the valve, and wherein the outer portion of the valve moves away from the spout in a closed position of the valve, wherein a combined length of the elongated neck, the spout, and the outer portion of the valve is greater than one-half the first diameter.

14. The liquid dispenser of claim 13, further comprising a spring and a collar, wherein the spring is situated between and operatively engages the inner portion of the valve and the spout, wherein the spring biases the valve to the closed position, wherein the spout is further comprised of an external thread, wherein the collar is further comprised of an internal thread and a central aperture, wherein the internal thread of the collar screws onto the external thread of the spout, and wherein the outer portion of the valve extends through the central aperture in the collar.

15. The liquid dispenser of claim 11, wherein the rigid top further comprises a tapered section between the lower section and the elongated neck in the upper section, wherein the rigid base has a central longitudinal axis, wherein the elongated neck and the spout are offset a lateral distance from the central longitudinal axis, and wherein the tube has a central axis aligned with the central longitudinal axis of the rigid base.

16. A liquid dispenser, comprising:

a rigid base comprising a container section and an open end at a topside of the container section, wherein the topside has a first diameter;

a rigid top comprising a lower section and an upper section, wherein the upper section further comprises an elongated neck extending to a spout, wherein the lower section has a second diameter approximately equal to the first diameter of the topside, wherein the spout has a third diameter less than or equal to one-quarter the second diameter, wherein the rigid top has a first arrangement separated from the rigid base and a second arrangement connected to the rigid base, wherein the rigid top further comprises a tapered section between the lower section and the elongated neck in the upper section, wherein the rigid base has a central longitudinal axis, wherein the elongated neck and the spout are offset a lateral distance from the central longitudinal axis, and wherein the tapered section of the rigid top is further comprised of an air inlet and a peripheral wall around the air inlet extending internally within the rigid top;

a tube comprised of a top end, a bottom end, and a center section between the top end and the bottom end, wherein the top section is further comprised of the air inlet spaced from the spout, wherein the top end of the tube connects to the air inlet, wherein the top end of the tube connects to the peripheral wall, wherein the center section of the tube extends toward the container section, wherein the tube has a central axis aligned with the central longitudinal axis of the rigid base, and wherein the bottom end of the tube is located proximate to the open end of the topside of the container section;

a valve connected to the spout, wherein the valve is further comprised of an inner portion adjacent to the spout and an outer portion extending away from the spout, wherein the outer portion of the valve moves toward the spout in an open position of the valve, and wherein the outer portion of the valve moves away from the spout in a closed position of the valve, and;

a spring operatively engaging the valve and the spout, wherein the spring biases the valve to the closed position.

17. The liquid dispenser of claim 16, wherein the rigid base further comprises at least one of a thin-film membrane and a removable lid, wherein the thin-film membrane or the removable lid is attached to the topside of the container section and covers the open end in a sealed configuration, and wherein the thin film membrane or the removable lid is detached from the topside of the container section in an unsealed configuration.

18. The liquid dispenser of claim 17, wherein the container section further comprises at least one of a premix solution, a premix powder, and a premixed beverage in the sealed configuration, and wherein the valve is at least one of a stem-valve and a tube-valve.

19. The liquid dispenser of claim 16, wherein the spout further comprises a tip with a plurality of notched standoffs around the valve.

20. The liquid dispenser of claim 16, further comprising at least one of an open bladder and a sealed bladder situated within the container section of the rigid base, wherein a top of the open bladder is secured between the topside of the container section and the lower section of the rigid top.

* * * * *